US007291103B1

(12) United States Patent
Estwanik

(10) Patent No.: US 7,291,103 B1
(45) Date of Patent: Nov. 6, 2007

(54) LOWER EXTREMITY STRETCHING DEVICE

(76) Inventor: Joseph J. Estwanik, 335 Billingsley Rd., Charlotte, NC (US) 28211

( * ) Notice: Subject to any disclaimer, the term of this patent is extended or adjusted under 35 U.S.C. 154(b) by 289 days.

(21) Appl. No.: 10/667,225

(22) Filed: Sep. 19, 2003

(51) Int. Cl.
*A63B 23/00* (2006.01)

(52) U.S. Cl. ..... 482/148; 482/79

(58) Field of Classification Search ..... 482/148, 482/140, 79, 146, 147, 34; 5/105; 297/258; 128/845–846, 882
See application file for complete search history.

(56) References Cited

U.S. PATENT DOCUMENTS

| | | | | |
|---|---|---|---|---|
| 1,441,940 | A * | 1/1923 | Nafe | 472/114 |
| 3,526,429 | A * | 9/1970 | Metzger | 297/271.5 |
| 4,205,876 | A | 6/1980 | Cetina | 297/118 |
| 4,241,949 | A * | 12/1980 | Parker | 297/3 |
| 4,815,732 | A | 3/1989 | Mahvi | 272/144 |
| D320,701 | S * | 10/1991 | Hoff | D6/348 |
| 5,605,526 | A * | 2/1997 | Hatfield | 482/142 |
| 5,713,820 | A | 2/1998 | Carbone | 482/79 |
| 5,728,035 | A | 3/1998 | Sands | 482/140 |
| 6,024,679 | A | 2/2000 | Castallanos et al. | 482/140 |
| 6,070,585 | A * | 6/2000 | Fery et al. | 128/845 |
| 6,203,473 | B1 | 3/2001 | Atwood | 482/95 |
| 2004/0110604 | A1 * | 6/2004 | Wu | |

* cited by examiner

*Primary Examiner*—Lori Amerson
(74) *Attorney, Agent, or Firm*—Alston & Bird LLP

(57) ABSTRACT

An apparatus and a first method of the invention for stretching a user's leg muscles, the apparatus comprising a rocker device having an arcuately shaped lower rocking surface for rocking motion on a generally flat surface and an upper platform surface having a recess for receiving a user's knee in a bent condition of the user's leg for stretching the user's quadriceps upon rocking motion, and the first method comprising the steps of: (a) resting the lower rocking surface on a generally flat surface; (b) placing a user's knee in a bent condition in the recess of the upper platform surface; and (c) rocking the apparatus forwards using the user's knee in the recess to guide the rocking motion of the rocker device for stretching the quadriceps. The apparatus is alternatively positionable in a second position for stretching the hamstring and calf muscles using a second method of the invention.

19 Claims, 3 Drawing Sheets

LOWER EXTREMITY STRETCHING DEVICE

FIELD OF THE INVENTION

The present invention relates to an exercise apparatus, and more particularly to an apparatus for stretching the quadriceps, hamstring and calf muscles.

BACKGROUND OF THE INVENTION

In recent years, there has been an increased focus on diet and exercise and the benefits of both to an individual's health. As a result of this increased focus, more individuals are exercising today than ever before.

Health and fitness professionals have long encouraged exercisers to perform stretching exercises prior to and after engaging in any type of exercise activity to prepare the exerciser's body for the rigorous exercise activity and to promote the relaxation of the exerciser's muscles following the exercise activity. These professionals have determined that exercisers that perform stretching exercises on a regular basis, both before and after engaging in an exercise activity, have an improved range of motion and are less likely to injure themselves during the performance of the exercise activity.

Unfortunately, effective techniques for stretching the quadriceps muscles do not exist. Traditional methods for stretching the quadriceps muscles have several disadvantages. First, traditional methods require hyperflexion of the knee joint in which the exerciser's knee is placed in an extreme position, thus exposing the exerciser's knee to injury. Exercisers with existing knee injuries find it painful and/or counter productive to assume these traditional positions. Second, traditional methods require the exerciser to position the exerciser's body in manner that requires balance, straining of the muscle, and positioning in a non-relaxed state. This positioning of the exerciser's body is antagonistic to the relaxation state that is most effective for stretching.

Thus, it is desirable to have a low-cost apparatus and method for effectively stretching the quadriceps muscle without hyperflexion of the knee joint. It is desirable that such apparatus and method prevent excessive forced ranges of movement of the knee joint. Further, it is desirable that such device and method allow the user to use the device and method without any unique posturing concerns (i.e., balance, strain, non-relaxed state, etc.), and that the user be able to position the user's knee in the apparatus in such a manner that the user can achieve a relaxed state of stretch. Finally, it is desirable that the device be capable of being used to stretch other leg muscles such as the hamstring and calf muscles without excessive forward flexion and strain to the lower back area.

Heretofore, the various forms of apparatuses and techniques that have been designed have not embodied the desirable qualities set forth above. Information relevant to one such attempt to address these problems can be found in U.S. Pat. No. 6,203,473, which relates primarily to a device that allows a user of the device to stretch and exercise all of the user's muscle groups by positioning the user's body and the apparatus in various relationships to one another. However, until now, there has not been an effective means and technique for stretching the quadriceps muscles.

SUMMARY OF THE INVENTION

It is accordingly an object of the present invention to provide an apparatus and method for allowing a user to effectively stretch the user's quadriceps muscles. More particularly, it is an object of the present invention to provide a low cost apparatus that can easily be used by a user to stretch the user's quadriceps muscles without hyper-extending the knee and creating injury or hyperflexing the spine to achieve a hamstring stretch. Further, it is an object of the present invention to provide an apparatus that does not require any unique or uncomfortable posturing by the user, and which does not require the user to force the user's muscles into a non-relaxed state or to strain the muscles. Finally, it is an object of the present invention to provide a method for effectively using the apparatus to stretch the quadriceps muscles, and to provide a method for alternatively using the apparatus to stretch the hamstring and calf muscles.

Briefly described, the objects of the present invention are achieved in an apparatus for stretching a user's leg muscles and a method for using the apparatus to stretch the user's leg muscles. The apparatus comprises a rocker device having a lower rocking surface that is arcuately shaped for rocking motion on a generally flat surface and an upper platform surface having a recess for receiving a user's knee in a 90° bent condition of the user's leg for stretching the user's quadriceps upon rocking motion. There are two methods for utilizing the present invention.

The first method comprises the steps of: (a) resting the lower rocking surface on a generally flat surface; (b) placing a user's knee in a bent condition in the recess of the upper platform surface; and (c) rocking the apparatus forward using the user's knee in the recess to guide the rocking motion of the apparatus for stretching the quadriceps muscles.

The second method includes steps for alternatively positioning the rocker device in a first position for stretching the quadriceps muscles as described above or alternatively positioning the rocker device in a second position for stretching the user's hamstring and calf muscles. The additional steps for alternatively stretching a user's hamstring and calf muscles in the second position are: (a) providing a device having a lower rocking surface that is arcuately shaped for rocking motion and an upper platform surface having a recess; (b) selectively positioning the device in a second position wherein the upper platform surface rests on a generally flat surface; and (c) selectively stretching the user's leg muscles by (i) stretching the hamstring muscles by (A) placing a heel of one of the user's outstretched legs on the lower rocking surface and (B) leaning forward towards the device for stretching the hamstring muscles, or (ii) stretching the calf muscles by placing one foot of the user's leg on the lower rocking surface while maintaining contact with the generally flat surface with the heel of the user's foot for stretching the calf muscles.

In the preferred embodiment of the present invention, the apparatus is comprised of a rocker device that has two surfaces, a lower rocking surface and an upper platform surface. The lower rocking surface is arcuately shaped for rocking the apparatus on a generally flat surface. The upper platform surface has a recess that is capable of receiving a user's knee in a bent condition for stretching the quadriceps muscle. In the preferred embodiment, the recess can be formed by fixedly attaching two platform surfaces to the lower rocking surface and the upper platform surface with the ends of the two platform surfaces attached to the lower rocker surface being positioned so as to form a 90 degree angle and more particularly, a concave cross member. The recess can be cushioned and should allow for the user to place the user's knee in the recess at an approximately 90 degree angle. In addition, the recess may contain indentures for positioning the user's shin bone in the indentures when the user's knee is received in the recess and handles for transporting the rocker device. As with the lower rocking surface, the upper platform surface can rest generally on a flat surface. Consequently, in the preferred embodiment of the present invention, the rocker device is alternatively positionable between a first position and a second position.

In the first position, the lower rocking surface rests on a generally flat surface allowing a user to position the user's knee bent at an approximately 90 degree angle in the recess of the upper platform surface for stretching the user's quadriceps muscle upon rocking motion of the rocking device. In the second position, the upper platform surface rests on a generally flat surface. In this position, a user can either position the user's heel or the user's foot of the user's leg on the lower rocking surface. If the user positions the user's heel on the lower rocking surface, the user can stretch the user's hamstring muscle, and if the user positions the user's foot on the lower rocking surface, the user can stretch the user's calf muscle.

The present invention also provides methods for using the apparatus to stretch the quadriceps muscle and alternatively the hamstring muscle or the calf muscle. The selective steps for stretching the quadriceps muscle of a user's leg muscle are: (a) resting the lower rocking surface of the apparatus on a generally flat surface, (b) placing a user's knee in a bent condition of approximately 90 degrees in the recess of the upper platform surface, and (c) rocking the apparatus forwards using the user's knee in the recess to guide the forward rocking motion of the apparatus for stretching the quadriceps muscles. The selective steps of stretching the hamstring muscle of a user's leg muscle are: (a) selectively positioning the apparatus in a second position wherein the upper platform surface rests on a generally flat surface, (b) placing a heel of one of the user's outstretched legs on the lower rocking surface, and (c) leaning forward towards the device for stretching the hamstring muscles. Finally, the selective steps for stretching the calf muscle of a user's leg muscle are: (a) selectively positioning the apparatus in a second position wherein the upper platform surface rests on a generally flat surface, and (b) stretching the calf muscle by placing one foot of the user's leg on the lower rocking surface while maintaining contact with the generally flat surface with the heel of the user's foot for stretching the calf muscles. In the preferred embodiment, the user's heel can be placed on the concave cross member for stretching the user's hamstring muscle and the user's foot can be placed on one of the lower platform surfaces for stretching the user's calf muscle.

Using the apparatus and methods of the present invention, it is possible for a user of the apparatus and the methods to more safely and effectively stretch the quadriceps muscles as well as the hamstring and calf muscles. This new and useful apparatus and the methods of utilizing the present invention reduce the likelihood that a user of the apparatus and the methods will injure the user's muscles or adjacent joints through hyperflexion or strain, or that the user will not stretch under relaxation or will loose the user's balance creating a greater risk of harm to the user.

Although the preferred embodiment has been described above, it, should be understood that the present invention could be adapted to other embodiments other than the preferred embodiment as described herein. The disclosed advantages of the present invention, and others, will become apparent upon reading the following detailed description and appended claims, and upon reference to the accompanying drawings.

BRIEF DESCRIPTION OF THE DRAWINGS

For a more complete understanding of the present invention, reference should now be had to the preferred embodiment of the present invention as described below and illustrated in greater detail in the accompanying drawings, which are not necessarily to scale.

DETAILED DESCRIPTION OF THE INVENTION

The present invention will be described more fully hereinafter with reference to the accompanying drawings, in which one preferred embodiment of the invention is shown. This invention may, however, be embodied in many different forms and should not be construed as being limited to the embodiment set forth herein. Rather, this embodiment is provided so that this disclosure will be thorough and complete and will fully convey the scope of the invention to those skilled in the art.

Figure 1:
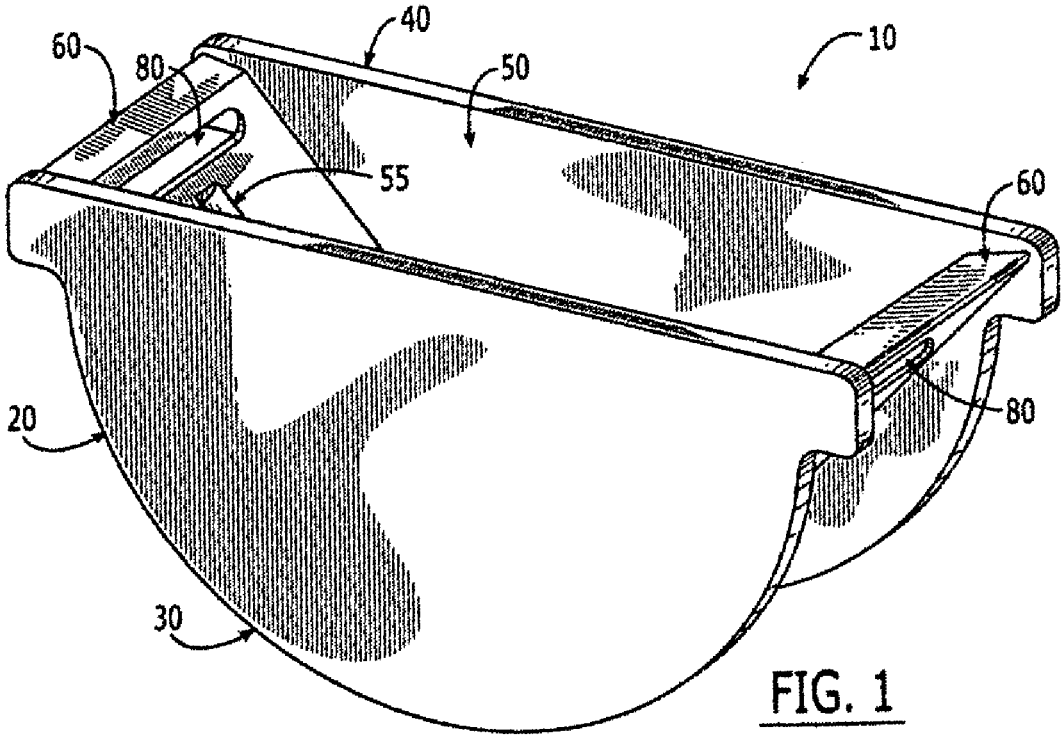
FIG. 1 is a perspective view of an embodiment of the stretching device of the present invention wherein the lower rocking surface rests on a generally flat surface.

Turning now to the accompanying drawings and initially FIG. 1, the stretching apparatus in accordance with the present invention is illustrated in its totality at 10. In the preferred embodiment of the present invention, the stretching apparatus 10 is comprised of a rocker device 20. The rocker device has a lower rocking surface 30 and an upper platform surface 40. The lower rocking surface 30 is arcuately shaped for rocking motion on a generally flat surface.

Figure 2:
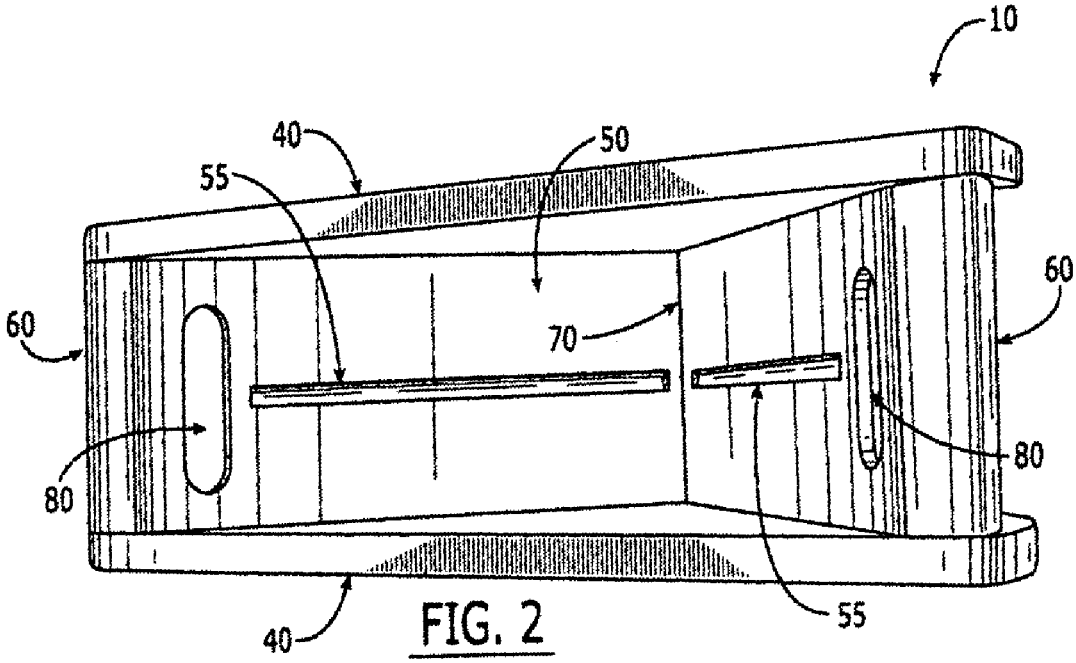
FIG. 2 is a top view of the stretching device of FIG. 1.
Figure 3:
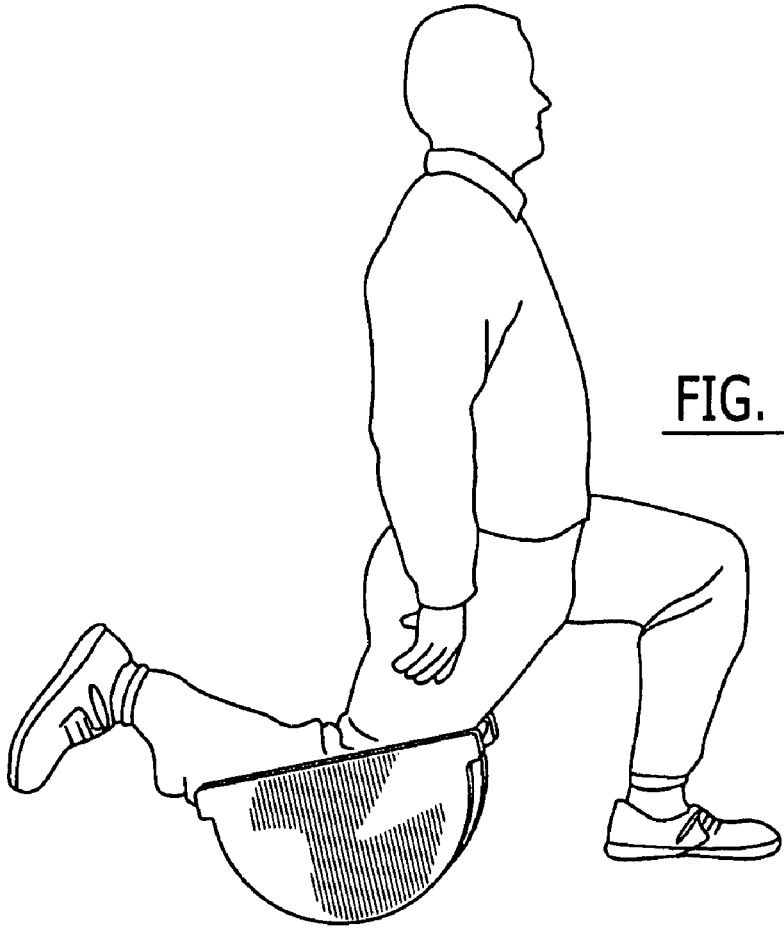
FIG. 3 is a perspective view of the stretching device of FIG. 1 showing the method of stretching the quadriceps muscles.

As illustrated in FIGS. 1 and 2, the upper platform surface 40 of the rocker device 20 of the preferred embodiment of the present invention has a recess 50. The recess 50 is capable of receiving a user's knee in bent condition of the user's leg into the recess 50 for stretching the user's quadriceps muscle upon rocking motion of the rocker device 20, and is designed such that the user's knee can be received into the recess 50 at an approximately 90 degree angle as illustrated in FIG. 3. As further illustrated in FIGS. 1 and 2, the recess 50 can be formed by fixedly attaching two platform surfaces 60 to the lower rocking surface 30 and the upper platform surface 40 with the ends of the two platform surfaces 60 that are attached to the lower rocking surface 30 being positioned so as to form a 90 degree angle and a concave cross member 70. The concave cross member 70 is more clearly illustrated in FIG. 4. The lower platform surfaces 60 may contain handles 80 providing for the easy transport of the rocker device 20. Further, in order to ensure that the user's knee and shin bone fit comfortably in the recess 50, the recess 50 of the rocker device 20 may be cushioned or include indentures 55.

Figure 4:
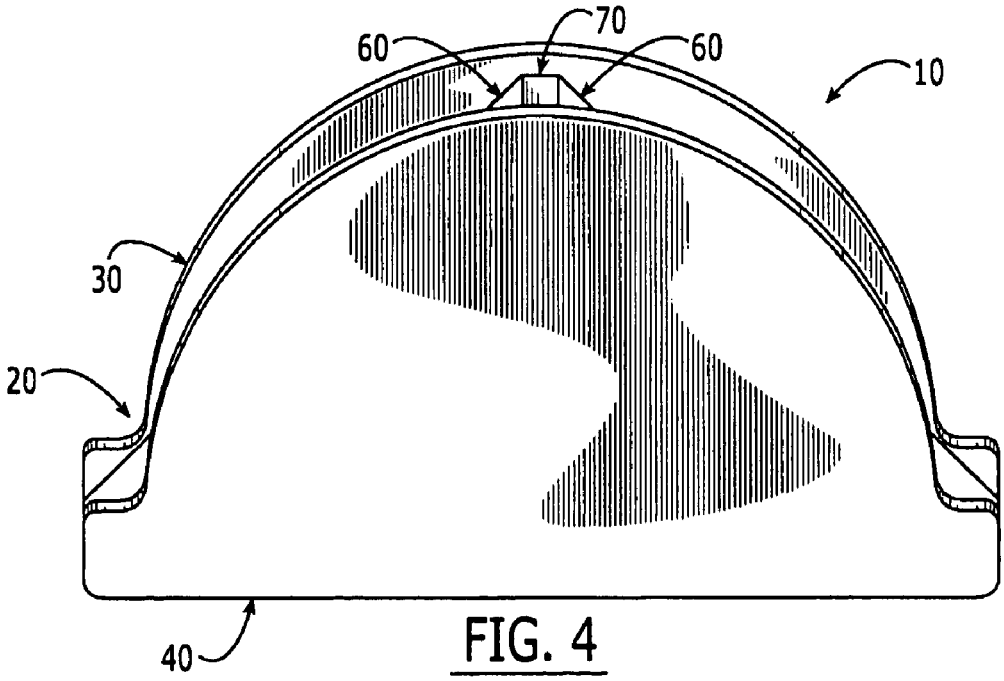
FIG. 4 is a perspective view of the stretching device of FIG. 1 wherein the upper platform surface rests on a generally flat surface.

Not only can the preferred embodiment of the present invention be positioned in a first position such that the lower rocking surface 30 rests on a generally flat surface, but as illustrated in FIG. 4, the rocker device 20 can be positioned in a second position in which the upper platform surface 40 of the rocker device 20 rests on a generally flat surface. This selective positioning of the rocker device 20 in a second position with the upper platform 40 resting on a generally flat surface allows a user alternatively to stretch the user's hamstring or calf muscles.

Figure 5A:
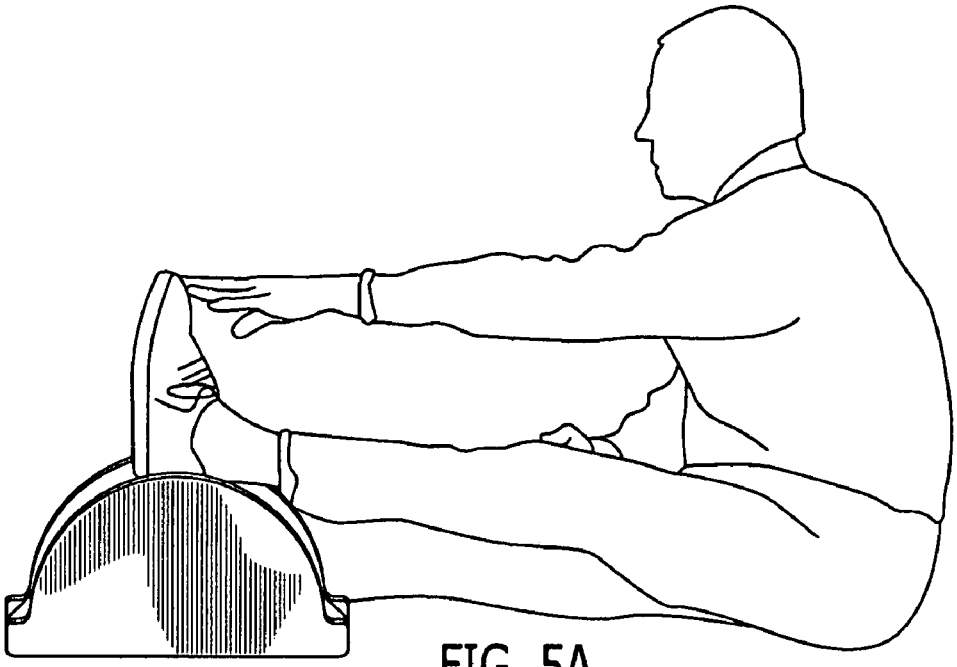
FIG. 5A is perspective view of the stretching device of FIG. 4 showing the method of stretching the hamstring muscles.
Figure 5B:
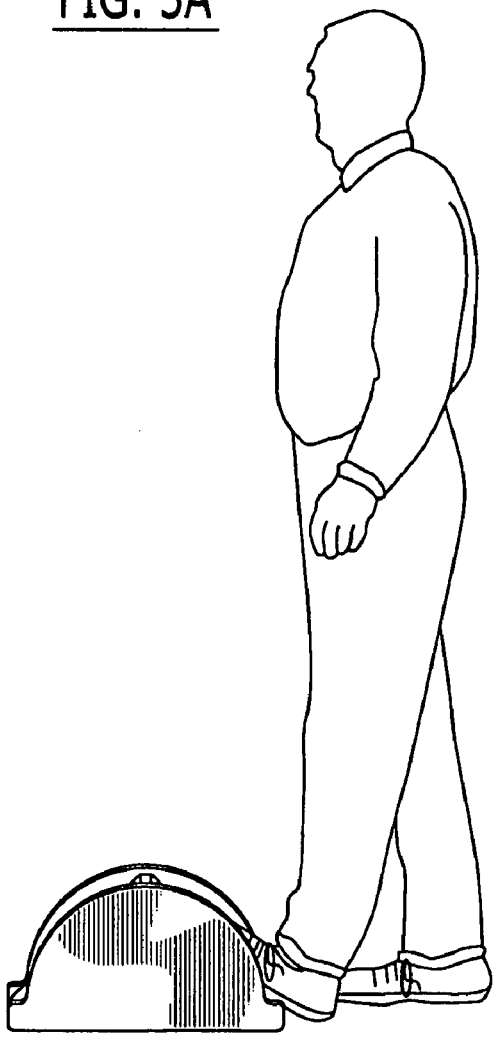
FIG. 5B is a perspective view of the stretching device of FIG. 4 showing the method of stretching the calf muscles.

As illustrated in FIGS. 5A and 5B, the second position of the rocker device 20 allows a user alternatively to position the user's heel of the user's leg on the lower rocking surface 30 for stretching the user's hamstring muscle, or to position the user's foot of the user's leg on the lower rocking surface 30 for stretching the user's calf muscles. In the preferred embodiment, the user's heel would be placed on the concave cross member 70 for stretching the user's hamstring muscle and the user's foot would be placed on one of the lower platform surfaces 60 for stretching the user's calf muscle.

There are two methods of utilizing the present invention, each of which allows a user to stretch the user's leg muscles. The first method allows a user to stretch the user's quadriceps muscles. The second method allows the user alternatively to position the present invention in a first position or a second position to selectively stretch the user's hamstrings or calf muscles.

The first method for stretching the user's quadriceps muscles using the rocker device 20 discussed above consists of essentially three steps and is illustrated in FIG. 3. First, the lower rocking surface 30 of the rocker device 20 is made to rest on a generally flat surface with the upper platform surface 40 in the upward position. Second, the user places the user's knee in a bent condition in the recess 50 of the upper platform surface 40 of the rocker device 20 with the user's knee generally bent at an approximately 90 degree angle preventing knee joint hyperflexion and the resultant injurious compressive forces. Third, with the user's knee in the recess of the upper platform surface 40, the user rocks the rocker device 20 forwards using the user's knee in the recess 50 to guide the rocking motion of the rocker device 20. The forward rocking motion of the rocker device 20 allows the user to gently stretch the user's quadriceps muscles.

The second method in which the user can alternatively position the present invention to selectively stretch the user's hamstrings or calf muscles consists of several steps as well. First, a rocker device 20 in accordance with the present invention must be provided having a lower rocking surface 30 that is arcuately shaped for rocking motion and an upper platform surface 40 having a recess 50. Second, the user must selectively position the rocker device 20 in a first position wherein the lower rocking surface 50 rests on a generally flat surface or in a second position wherein the upper platform surface 40 rests on a generally flat surface. Third, if the user has positioned the rocker device 20 in the first position, the user can proceed to stretch the user's quadriceps muscle. However, if the user has positioned the rocker device 20 in the second position, the user must determine which muscle the user desires to stretch, the hamstring or the calf muscle.

If the user desires to stretch the quadriceps muscle, the user must place the user's knee in a bent condition in the recess 50 of the upper platform surface 40 with the user's knee generally bent at an approximately 90 degree angle as illustrated in FIG. 3. The user must then rock the rocker device 20 forwards using the user's knee in the recess 50 to guide the rocking motion of the rocker device 20, thereby gently and effectively stretching the quadriceps muscle. Similarly, with the rocker device 20 maintained in the second position, if the user desires to stretch the hamstring muscle of the user's leg, the user places a heel of one of the user's outstretched legs on the lower rocking surface 50 as illustrated in FIG. 5A. The user then leans forward towards the rocker device 20 stretching the hamstring muscles. On the other hand, if the user desires to stretch the calf muscle of the user's leg, the user places one foot of the user's leg on the lower rocking surface 30 while maintaining contact with the generally flat surface with the heel of the user's foot as illustrated in FIG. 5B. This position allows the user to gently stretch the calf muscles. As previously noted, in the preferred embodiment, the user's heel would be placed on the concave cross member 70 for stretching the user's hamstring muscle and the user's foot would be placed on one of the lower platform surfaces 60 for stretching the user's calf muscle.

Overall, the design of the stretching apparatus and the methods for using the stretching apparatus are advantageous because the apparatus and methods provide a low cost means for easily and safely stretching a user's leg muscles without the assistance of a second person. Further, because of the design of the apparatus and the simple methods of using the apparatus, a user is less likely to be injured because of hyperflexion of the knee or muscle strain.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that all modifications, alternatives, equivalents and other embodiments are intended to be included within the scope of the appended claims.

What is claimed is:

1. An apparatus for stretching a user's leg muscles, comprising a rocker device having at least a pair of lower rocking surfaces that are arcuately shaped with a constant radius for rocking motion on a generally flat surface and an upper platform surface extending between opposing ends of a respective rocking surface, wherein a recess is defined between the rocking surfaces by substantially only two angularly converging platform surfaces fixedly attached between the lower rocking surfaces and respective upper platform surfaces for receiving a user's knee in a bent condition of the user's leg for stretching the user's quadriceps upon rocking motion.

2. An apparatus in accordance with claim 1, wherein the recess is cushioned.

3. An apparatus in accordance with claim 1, wherein the rocker device has at least one handle for transporting the rocker device.

4. An apparatus in accordance with claim 1, wherein at least one of the angularly converging platform surfaces has at least one indentation for receiving the user's shin bone when the user's knee is received in the recess in a bent condition.

5. An apparatus in accordance with claim 1, wherein the two platform surfaces are attached at an angle of approximately 90 degrees to one another for receiving a user's knee in bent condition.

6. An apparatus in accordance with claim 1, wherein a substantial portion of each upper platform surface is configured to rest on a generally planar surface allowing a user alternatively to position the user's heel of the user's leg on at least a portion of at least one of the angularly converging platform surfaces for stretching the user's hamstring muscle or to position the user's foot of the user's leg on at least a portion of one of the angularly converging platform surfaces for stretching the user's calf muscle.

7. An apparatus for stretching a user's leg muscles, comprising a rocker device having at least a pair of lower rocking surfaces that are arcuately shaped with a constant radius for rocking motion and an upper platform surface extending between opposing ends of a respective rocking surface, wherein a recess is defined between the rocking surfaces by substantially only two angularly converging platform surfaces fixedly attached between the lower rocking surface and the upper platform surface, said rocker device being alternatively positionable between a first position wherein the lower rocking surface rests on a generally flat surface allowing the user to position the user's knee in a bent condition of the user's leg in the recess of the upper platform surface for stretching the user's quadriceps upon rocking motion, and a second position wherein the upper platform surface rests on a generally flat surface allowing a user to position alternatively the user's heel of the user's leg on at least a portion of at least one of the angularly converging platform surfaces for stretching the user's hamstring muscle or to position the user's foot of the user's leg on at least a portion of one of the angularly converging platform surfaces for stretching the user's calf muscle.

8. An apparatus in accordance with claim 7, wherein the recess is cushioned.

9. An apparatus in accordance with claim 7, wherein the rocker device has at least one handle for transporting the rocker device.

10. An apparatus in accordance with claim 7, wherein at least one of the angularly converging platform surfaces has at least one indentation for receiving the user's shin bone when the user's knee is received in the recess in a bent condition.

11. An apparatus in accordance with claim 7, wherein the two platform surfaces are attached at an angle of approximately 90 degrees to one another for receiving a user's knee in bent condition.

12. A method of stretching a user's leg muscles using an apparatus comprising a rocker device having at least a pair of lower rocking surfaces that are arcuately shaped with a constant radius for rocking motion on a generally flat surface and an upper platform surface extending between opposing ends of a respective rocking surface, wherein a recess is defined between the rocking surfaces by substantially only two angularly converging platform surfaces fixedly attached between the lower rocking surface and the upper platform surface for receiving a user's knee in a bent condition of the user's leg for stretching the user's quadriceps upon rocking motion, the method comprising the steps of:

a. resting the lower rocking surface on a generally flat surface;

b. placing a user's knee in a bent condition in the recess of the upper platform surface; and c. rocking the apparatus backwards and forwards using the user's knee in the recess to guide the rocking motion of the rocker device for stretching the quadriceps muscles.

13. A method in accordance with claim 12, wherein the two platform surfaces are attached at an angle of approximately 90 degrees to one another for receiving a user's knee in bent condition.

14. A method of stretching a user's leg muscles, the method comprising the steps of:

a. providing a device having at least a pair of lower rocking surfaces that are arcuately shaped with a constant radius for rocking motion and an upper platform surface extending between opposing ends of a respective rocking surface, wherein a recess is defined between the rocking surfaces by substantially only two angularly converging platform surfaces fixedly attached between the lower rocking surface and the upper platform surface;

b. selectively positioning the device in a first position wherein the lower rocking surface rests on a generally flat surface or a second position wherein the upper platform surface rests on a generally flat surface; and c. selectively stretching the user's leg muscles by:

i. stretching the quadriceps muscles in said first position by:

A. placing a user's knee in a bent condition in the recess of the upper platform surface; and B. rocking the device backwards and forwards using the user's knee in the recess to guide the rocking motion of the device for stretching the quadriceps muscles; or ii. stretching the hamstring muscles in said second position by:

A. placing a heel of one of the user's outstretched legs on at least a portion of at least one of the angularly converging platform surfaces; and B. leaning forward towards the device for stretching the hamstring muscles; or iii. stretching the calf muscles in said second position by placing one foot of the user's leg on at least a portion of one of the angularly converging platform surfaces while maintaining contact with the generally flat surface with the heel of the user's foot for stretching the calf muscles.

15. A method in accordance with claim 14, wherein the two platform surfaces are disposed at an angle of approximately 90 degrees to one another for receiving a user's knee in bent condition.

16. An apparatus in accordance with claim 1, wherein the lower rocking surface is semi-circular.

17. An apparatus in accordance with claim 4, wherein at least one indentation is defined in, and extends substantially along, a respective angularly converging platform surface.

18. An apparatus in accordance with claim 1, wherein each upper platform surface is substantially planar.

19. A method in accordance with claim 12, wherein each upper platform surface is substantially planar.

* * * * *